United States Patent [19]

Nikitina et al.

[11] Patent Number: 4,906,255

[45] Date of Patent: Mar. 6, 1990

[54] ABRASIVE MATERIAL

[76] Inventors: Tatyana P. Nikitina, Institutsky prospekt, 29, kv. 59, Leningrad; Jury M. Kovalchuk, pereulok Vasnetsova, 15, kv. 11, Moscow; Valentina V. Larionova, ulitsa Lenina, 52, kv. 19, Leningrad; Alexandr N. Volokhonsky, pereulok Iliicha, 9, kv. 7, Leningrad; Vladislav P. Lukanin, ulitsa Chaikovskogo, 70, kv. 153, Chelyabinsk; Mikhail G. Efros, naberezhnaya reki Moiki, 1/7, kv. 53, Leningrad; Ivan P. Vasiliev, ulitsa Pelshe, 2/1, kv. 279, Leningrad; Ilya Z. Pevzner, ulitsa Soldata Korzuna, 52, kv. 141, Leningrad, all of U.S.S.R.

[21] Appl. No.: 295,489

[22] Filed: Jan. 10, 1989

[51] Int. Cl.[4] ..... B24D 3/02

[52] U.S. Cl. ..... 51/307; 51/309

[58] Field of Search ..... 51/307, 309

[56] References Cited

U.S. PATENT DOCUMENTS

| | | | |
|---|---|---|---|
| 4,063,908 | 12/1977 | Ogawa et al. | 51/307 |
| 4,341,533 | 7/1982 | Diare et al. | 51/309 |
| 4,643,983 | 2/1987 | Zeiringer | 51/307 |
| 4,799,938 | 1/1989 | Jang et al. | 51/309 |

*Primary Examiner*—A. Lionel Clingman
*Assistant Examiner*—Willie J. Thompson
*Attorney, Agent, or Firm*—Ladas & Parry

[57] ABSTRACT

A material containing corundum crystals from 5 to 350 microns in size and any one of the additions: spinel, anorthitic glass, cordieritic glass, or a mixture of spinel and either of said glasses. Said addition amounts to 1.5–7.5% by mass of the abrasive material and is spread between the corundum crystals in the form of interlayers less than 20 microns thick.

1 Claim, No Drawings

ABRASIVE MATERIAL

FIELD OF THE INVENTION

The present invention relates to the production of high-melting high-hardness non-organic materials, and more specifically, to abrasive materials which substantially are products of the electrothermal process and which contain as a base high-hardness high-strength corundum crystals ($\alpha.Al_2O_3$). The abrasive material is intended for making abrasive grains by means of its desintegration. The abrasive grains are mostly used for producing abrasive tools on ceramic and organic bonds, to be employed in metal working.

BACKGROUND OF THE INVENTION

The abrasive grains obtained by the process of desintegration of an abrasive material can be divided into two groups. A first group includes monocrystal grains consisting of a single corundum crystal. The second group comprises aggregate grains containing several corundum crystals at the interfaces of which or within which there are found inclusions of ancillary impurity minerals.

The main features characterizing the abrasive material are strength and abrasiveness of the abrasive grains produced thereof as well as its cost and scarcity.

The strength of monocrystal abrasive grains is determined by the strength of the corundum crystals. These grains feature, as a rule, a higher strength as compared to the aggregate grains. The aggregate grain strength depends on the size of the corundum crystals contained in these grains, the quantity and type of the ancillary minerals such as impurities and additions found, as inclusions, at the interfaces of the corundum crystals, and on the size of these inclusions. As a rule, the smaller the size of the corundum crystals and the quantity and size of the impurity mineral inclusions and the higher the strength of these minerals, the higher the strength of the aggregate grains.

The abrasiveness of the grains is determined by the hardness of the corundum crystals, impurities, and additions and depends on the ability of the grains to self-sharpen, that is, to form new cutting faces upon destruction of the grains in the process of metal working.

All the abrasive materials are produced by melting the starting abrasive material followed by cooling of the resulting melt, in the course of which the melt is crystallized. The desired structure of the abrasive material (grain size of the main crystals, inclusion size and so on) is achieved by selecting the mode of cooling of the melt.

There are known abrasive materials consisting of corundum crystals. A typical representative of these abrasive materials is white synthetic corundum. This synthetic corundum comprises inclusions of the impurity mineral $Na_2O.11Al_2O_3$ which are from 50 to 700 microns in size (A.P.Garshin et al., "Abrasivnye materialy", 1983, Masinostroenie (Leningrad), pp.119–123).

To obtain the white synthetic corundum, technically pure aluminum oxide, that is alumina, is used as a source material.

In the course of processing the white synthetic corundum to obtain abrasive grains, part of the impurity mineral, particularly that present in the form of coarse inclusions having size from 300 to 700 microns, is ground down to the size of slime particles and removed. As a result, the obtained abrasive grains become somewhat enriched in corundum crystals as compared to the starting abrasive material, that is, feature a higher strength. Part of the abrasive grains obtained in processing white synthetic corundum are monocrystal grains, and part, aggregate grains containing inclusions of $Na_2O.11Al_2O_3$ sized from 50 to 250 microns.

Such abrasive materials produced by melting alumina are disadvantageous in that these contain the high-alumina sodium aluminate $Na_2O.11Al_2O_3$ formed in the process of making the abrasive material due to the presence of sodium oxide in the alumina and crystallized out at the corundum crystal interfaces. The presence of the high-alumina sodium aluminate at the corundum crystal interfaces, which are stress concentrators, results in a lowered mechanical strength of the aggregate grains produced from this material. Moreover, since the high-alumina sodium aluminate features a lower hardness than that of corundum, the presence of said inclusions results in a decreased abrasiveness of the grains.

Also known are abrasive materials produced by melting alumina with adding to the melt titanium, chromium, vanadium oxides or a mixture thereof followed by cooling of the obtained melt (A. P.Garshin et al., "Abrazivnye materialy", 1983, Mashinostroenie (Leningrad), pp.123–126).

In the process of manufacturing these materials, any one of said additions forms solid solutions of these compounds in the aluminum oxide, whereby the strength of the corundum crystals increases, that is, the strength of the abrasive grains obtained from this material becomes higher.

However, the abrasiveness of the grains made from this material is not sufficiently high, as in the case with the previously mentioned material, due to the presence of the inclusions of $Na_2O.11Al_2O_3$ having size from 50 to 250 microns.

Besides, each of said additions present in the abrasive material brings its own shortcomings. The abrasive material produced with adding titanium oxide contains inclusions of titanium nitrides and carbides which results in the loss of strength of the abrasive grains in manufacturing abrasive tools. This is attributed to the fact that, in the process of manufacturing abrasive tools, during thermal treatment of the grains of this material at a temperature of about 1100 ° C., oxidation occurs of the titanium carbides and nitrides contained in the abrasive material, accompanied by changes in volume of these, which results in the loss of strength of the abrasive grains. The abrasive material produced with adding chromium oxide contains metallic chromium inclusions tending to deteriorate the abrasive properties of the tools to be manufactured therefrom, namely, to increase the probability of burns during metal working (grinding). As for the vanadium additions, the use of these in the abrasive materials proved to be impractical due to scarcity and high cost of vanadium.

There is known an abrasive material containing crystals of corundum and baddeleyite (zirconium oxide). In this material, the corundum crystals from 10 to 70 microns in size are bonded with each other by fine-crystal corundum-baddeleyite eutectic with crystals measuring 1 to 5 microns (A.P.Garshin et al., "Abrazivnye materialy", 1983, Mashinostroenie (Leningrad), pp.126–131).

The strength of the abrasive grains produced from such an abrasive material is higher than that of the abovementioned materials, which is attributed, in the first place, to the presence of the corundum-baddeleyite eutectic.

However, since baddeleyite features a lower hardness as compared to corundum, the abrasiveness of the abrasive grains is not adequate.

Moreover, the baddeleyite present in the abrasive material makes this abrasive material suitable for manufacturing abrasive tools on an organic bond only, since at a temperature of 1100 ° C. (the thermal treatment temperature in manufacturing abrasive tools), the zirconium oxide undergoes modifications accompanied by considerable changes in volume, whereby a significant loss of strength of the abrasive grains, down to destruction thereof takes place.Another shortcoming of this material is its scarcity and high cost because of the zirconium oxide present therein.

SUMMARY OF THE INVENTION

It is an object of the present invention to increase the strength of the abrasive grains produced from the abrasive material.

It is another object of the present invention to increase abrasiveness of the grains produced from the abrasive material.

It is still another object of the present invention to lower cost and scarcity of the abrasive material.

It is still further object of the inention to provide abrasive material which enables abrasive tool manufacturing with the use of ceramic bond.

With these and other objects in view, there is provided an abrasive material containing corundum crystals from 5 to 350 microns in size and a mineral selected from the group consisting of spinel, anorthitic glass, cordieritic glass, and a mixture of spinel and either of said glasses. Said mineral amounts to 1.5 to 7.5% by mass of the abrasive material and is spread between the corundum crystals in the form of interlayers less than 20 microns thick.

The inventors have found experimentally that the corundum-based abrasive material containing as an addition, spinel ($MgO.Al_2O_3$), anorthitic glass ($2MgO.5SiO_2.2Al_2O_3$), cordieritic glass ($CaO.Al_2O_3.2SiO_2$) or a mixture of said minerals has, in its microstructure, depositions of appropriate phase: magnesia spinel and/or cordieritic or anothitic glass spread between the corundum crystals in the form of interlayers. Since any one of said addition materials is thermostable at a temperature of 1000° to 1300 ° C. (temperature of burning of the abrasive tools), no loss of strength of the tool occurs during its manufacturing. Besides, since the minerals used as the addition feature high microhardness, approximating more closely, as compared to other minerals, the corundum microhardness, the abrasive material containing this addition has a high abrasiveness.

When producing the abrasive material during crystallization of the corundum melt containing calcium, magnesium, and silicium oxides, the phases of said minerals, developing between the corundum crystals, contribute to formation of new crystallization centres rather than to the continued growth of the primary corundum crystals.

Owing to this, an isometric fine-crystal structure of the abrasive material is obtained having a positive effect on the strength features of the abrasive grain produced therefrom.

The corundum crystal size and interlayer thickness depend on the mode of cooling the melt in producing the abrasive material.

As the inventors have found, with the corundum crystal sizes under 5 microns the abrasiveness of the grains lowers markedly, which is attributed to the changes in the nature of their wear. Instead of gradual spalling of corundum crystal sections, formation of wear sites occurs with a relatively smooth relief.

With the corundum crystals exceeding 350 microns in cross-section, the abrasive grain strength drops drastically.

With the interlayer thickness exceeding 20 microns, the abrasive grain strength begins to lower abruptly, since these become stress concentrators.

With the addition content less than 1.5 % by mass, an abrupt decrease of the abrasive grain strength is observed.

With the addition content more than 7.5 % by mass, the abrasiveness of the abrasive grain decreases significantly due to the decreasing of the amount of the most hard phase (corundum) in the grain.

Description of the Preferred Embodiment

The abrasive material is produced as follows. In a conventional manner (A.P.Garshin et al., "Abrazivnye materialy", 1983, Mashinostroenie (Leningrad), pp.119–121, 126–131) aluminum oxide is melted in an electricarc furnace with additions containing one or more oxides from the group MgO, SiO, CaO, for example, magnesium silicate, calcium silicate, or pure oxides. The percentage of the additions introduced is calculated according to the abrasive material composition desired and the mass fraction of the addition minerals of the total mass therein. For example, based on a stoichiometric ratio, 1.4% of magnesium oxide is to be added into the mixture to obtain a material containing 5% by mass of the spinel interlayers. The mineral interlay thickness is adjusted by controlling the process of cooling of the melt. Thus, upon a relatively rapid cooling of the melt in small containers filled with metallic bodies, such as balls for instance, or in roller-crystallizers, the resulting abrasive material has corundum crystals dimensioning from 5 to 90 microns with mineral interlayers from 0.3 to 5.0 microns thick. Upon a relatively slow cooling of the melt, for example in ingots having a mass of 5 to 500 kg, abrasive material is obtained with corundum crystals dimensioning from 280 to 350 microns and interlayers from 10 to 20 microns thick. Subsequent to cooling, the crystallized material undergoes crushing, desintegration and screening.

The quality of the obtained material is judged by the strength and abrasiveness of the abrasive grains produced therefrom. In particular, the material was tested for strength by carrying to failure 100 grains 1250 to 1600 microns in size between hard alloy plates.

The abrasiveness was evaluated by a conventional abrasion test employing glass disks. Abrasive grains from 120 to 160 microns in size were used.

The test data for the abrasive materials of various compositions and structures are given in Tables 1 and 2.

TABLE 1

| | Abrasive material composition | Dependence of abrasive grain properties on additional mineral content: Predominant size of addition mineral interlayers, microns | Corundum crystal size, microns | Addition mineral content, % by mass | Single grain strength (N) | Abrasiveness (g) |
|---|---|---|---|---|---|---|
| | corundum + cordieritic glass | | | | | |
| 1. | | 10–20 | 280–350 | 1.5–2.0 | 290 | 0.063 |
| 2. | | | 270–330 | 3–4 | 280 | 0.061 |
| 3. | | | 250–300 | 7–7.5 | 260 | 0.059 |
| 4. | | | 280–350 | 0.6–1.0 | 190 | 0.057 |
| 5. | | | 250–300 | 8–10 | 200 | 0.048 |
| | corundum + spinel | | | | | |
| 6. | | 10–20 | 280–350 | 1.5–2.0 | 200 | 0.061 |
| 7. | | | 260–320 | 3–4 | 160 | 0.060 |
| 8. | | | 250–300 | 7–7.5 | 150 | 0.058 |
| 9. | | | 290–350 | 0.6–1.0 | 120 | 0.056 |
| 10. | | | 240–300 | 8–10 | 130 | 0.050 |
| | corundum + spinel + cordieritic glass | | | | | |
| 11. | | 4–7 | 35–80 | 1.5–2.5 | 290 | 0.070 |
| 12. | | | 40–90 | 3–4.5 | 290 | 0.070 |
| 13. | | | 40–80 | 7–7.5 | 270 | 0.067 |
| 14. | | | 35–90 | 0.6–1.0 | 220 | 0.060 |
| 15. | | | 25–70 | 8–10 | 240 | 0.048 |

TABLE 2

| Ord. N. | Abrasive material composition | Dependence of abrasive grain properties on composition and structure: Predominant size of addition mineral interlayers, microns | Corundum crystal size, microns | Single grain strength (N) | Abrasiveness (g) |
|---|---|---|---|---|---|
| 1 | corundum + spinel | 0.3–0.6 | 5–10 | 250 | 0.062 |
| 2 | | 3–5 | 40–90 | 180 | 0.067 |
| 3 | | 10–20 | 280–350 | 160 | 0.060 |
| 4 | | 10–20 | 400–600 | 60 | 0.049 |
| 5 | | 0.3–0.6 | 3–5 | 100 | 0.047 |
| 6 | | 25–40 | 280–350 | 100 | 0.050 |
| 7 | corundum + cordieritic glass | 0.3–0.6 | 5–10 | 290 | 0.063 |
| 8 | | 3–5 | 40–90 | 270 | 0.073 |
| 9 | | 10–20 | 280–350 | 240 | 0.068 |
| 10 | | 25–40 | 400–600 | 70 | 0.048 |
| 11 | | 0.1–0.2 | 3–5 | 190 | 0.047 |
| 12 | corundum + cordieritic glass + spinel | 0.3–0.6 | 5–10 | 320 | 0.062 |
| 13 | | 4–7 | 35–80 | 290 | 0.070 |
| 14 | | 10–20 | 250–340 | 260 | 0.067 |
| 15 | | 25–40 | 450–700 | 80 | 0.051 |
| 16 | | 0.1–0.2 | 3–5 | 130 | 0.049 |
| 17 | corundum + anorthitic glass | 0.3–0.7 | 5–10 | 280 | 0.064 |
| 18 | | 4–8 | 40–90 | 260 | 0.073 |
| 19 | | 12–24 | 270–350 | 210 | 0.067 |
| 20 | | 26–40 | 450–650 | 70 | 0.052 |
| 21 | | 0.1–0.2 | 3–5 | 180 | 0.049 |
| 22 | corundum + zirconium oxide (a prior art composition) | 2.0–5.0 | 20–40 | 240 | 0.048 |
| 23 | corundum + titanium oxide + sodium aluminate (a prior art composition) | 30–100 | 500–000 | 120 | 0.058 |

As will be seen from Table 1, with the content of the proposed addition below 1.5 % by mass (rows 4, 9, 14), the strength of the abrasive grain lowers abruptly, and with the content of the addition above 7.5 % by mass (rows 5, 10, 15), the abrasiveness of the grain decreases considerably.

As will be seen from Table 2, with the corundum crystal size in the proposed abrasive material below 5 microns (rows 5, 11, 16, 21), the abrasiveness of the grains decreases considerably, and with the corundum crystal size above 350 microns (rows 4, 10, 15, 20) and/or with the thickness of the addition mineral interlayers above 20 microns (rows 6, 10, 15, 20), the abrasive grain strength pronouncedly lowers.

Investigations were conducted by the inventors on thermal treatment of the abrasive grains from the proposed abrasive material at temperatures of 1100 to 1300 ° C. (the temperature of burning in manufacturing abrasive tools) to show that the strength of the abrasive grains does not therewith decreases.

What is claimed is:

1. An abrasive material containing corundum crystals having a size of 5 to 350 microns, and a mineral selected from the group consisting of spinel, anorthitic glass, cordieritic glass, and a mixture of spinel and either of said glasses, said mineral amounting to 1.5 to 7.5 % by mass of said abrasive material and spreading between the corundum crystals in the form of interlayers less than 20 microns thick.

* * * * *